US006061970A

United States Patent [19]

Fujita

[11] Patent Number: 6,061,970

[45] Date of Patent: May 16, 2000

[54] ELECTRICALLY OPERATED MULTIPLE FOLDING STAGE SYSTEM

[76] Inventor: Kazuo Fujita, 1, Hagiyamadai 1-chome, Seto-shi, Aichi-ken, Japan

[21] Appl. No.: 09/162,169

[22] Filed: Sep. 29, 1998

[30] Foreign Application Priority Data

Sep. 30, 1997 [JP] Japan ..... 9-265335

[51] Int. Cl.[7] ..... E04H 3/26

[52] U.S. Cl. ..... 52/7; 52/6; 182/223

[58] Field of Search ..... 52/6, 7; 182/223

[56] References Cited

U.S. PATENT DOCUMENTS

| | | | |
|---|---|---|---|
| 2,978,754 | 4/1961 | Wilson | 52/7 X |
| 4,872,295 | 10/1989 | Fujita | 52/7 |
| 5,016,403 | 5/1991 | Fujita | 52/7 |
| 5,069,006 | 12/1991 | Fujita | 52/7 |
| 5,325,640 | 7/1994 | Luedke et al. | 52/7 X |
| 5,613,450 | 3/1997 | Wagner et al. | 52/7 X |

FOREIGN PATENT DOCUMENTS

| | | |
|---|---|---|
| 2549561 | 8/1996 | Japan . |
| 2704234 | 10/1997 | Japan . |

*Primary Examiner*—Beth A. Aubrey
*Assistant Examiner*—Brian E. Glessner
*Attorney, Agent, or Firm*—Muramatsu & Associates

[57] ABSTRACT

An electrically operated multiple folding stage system which enables a number of linked stage systems to move sequentially from a vertical to horizontal position (unfolding), or from a horizontal to a vertical position (folding-up), as a unit in a single smooth operation. The multiple folding stage system includes first and second stage systems connected in series in a front/back direction each having a front stage component and a rear stage component connected with one another in a manner to be freely folded or unfolded in such a way that a connection point between the front and rear stage components moves in a vertical direction, a first link bar provided at the rear stage component of the first stage system, a second link bar provided at the front stage component of the second stage system, a stay integrally formed with a rear end of the first link bar in a direction inclined relative to a direction of the first link bar, and a link member pivotally connected to a front end of the second link bar at one end thereof and connected to the stay at another end thereof. The stay and the link member are pivotally connected with one another and forming an angle of connection which is substantially smaller than 180 degree when the first and second stage systems are unfolded and laying flat on a floor, and the angle of connection is increased when either the first stage system or second stage system starts folding by rotation of the stay and the link member, thereby increasing a distance between the first stage system and the second stage system. In a further aspect, the multiple folding stage system includes a pair of stays rather than a single stay so that the first stage system and the second stage system are folded or unfolded at the same time.

20 Claims, 10 Drawing Sheets

ELECTRICALLY OPERATED MULTIPLE FOLDING STAGE SYSTEM

FIELD OF THE INVENTION

This invention relates to electrically-operated multiple folding stage systems.

BACKGROUND OF THE INVENTION

This invention covers the technical field of a multiple folding stage system in which a number of the front and rear folding stage components can be smoothly moved on a floor, or folded up and compactly stored against a wall or the like.

The inventor has already proposed in previous Japanese Published Examined Patent Application Nos. 7-21258, 7-116855, and Japanese Patent Nos. 2521528, 2549561, 2549562, two different types of electrically-operated folding stage system, namely a high-type system with long legs which may freely be folded up and a low-type system which has comparatively short legs.

This system enables the entire body of the front and rear stage components to be vertically folded up and horizontally moved against the wall. At the same time, a balancer mechanism supporting both components operated by an electric motor enables the entire body to be moved along the floor and displaced, or stored against a wall or the like.

In the aforementioned folding stage system, the surface of the front and rear stage components may be covered with "tatami mats" or straw mats for judo, or with mats for wrestling or gymnastics. Or if the stage floor needs to be covered with shock absorbing structure, this folding system also can be used for kendo, i.e. a Japanese traditional martial art similar to western fencing. If the stage system is convenient for such purposes, it may not be necessary either to spread or to take up tatami mats any more. Therefore, if the aforementioned stage system is installed on the walls of a gymnasium, this system will create sufficient space for other purposes as well as sports as long as the building can provide the space.

However, if a large number of people plan to use the stage system for sports at the same time, it would be necessary to obtain a multiple-version of the folding stage system. In order to do so, in the aforementioned invention of the electrically-operated folding stage system proposed in Japanese Published Examined Patent Application Nos. 7-21258 and 7-116855, it would be necessary to multiply the front and rear components of the stage system which could be folded together, and each end of the opposite components should be connected with the hinges on the floor. A multiple-version of the folding stage system could be folded up and easily stored. This system consequently provides a larger space for a stage.

When tatami mats or other mats are actually spread on the floor of the multiple folding stage system, the thickness of the stage body should be at least 10 centimeters.

However, under some conditions the structure which connects a multiple-version of the folding stage system with the thickness by using the link hinges described in Japanese Published Examined Patent Application Nos. 7-21258 and 7-116855, might not function. A multiple-version of the stage system with a certain thickness may not be smoothly moved because the faces of the stage systems folded together may stick to each other, or sometimes one face of a stage may cut into the other face of the stage. In that case, it is not possible to install a pair of the front and rear stage components such that they may be moved smoothly. In other words, such a multiple-version of the folding stage system cannot function properly because of an insufficient clearance between the front and rear stage components.

In regard to the multiple folding stage system which enables a number of the front and rear stage components, pivotally connected, to be vertically folded and horizontally moved from the floor, the inventor, in order to solve the problems mentioned above, provides herein a novel multiple folding stage system. In the folding stage system, a stay may be placed on the rear end of the link in order to fold up the legs mounted on the rear component of the front stage system, also this folding stage system includes link features to connect the front stage component of the rear stage system with the link shafts widthways right and left.

SUMMARY OF THE INVENTION

It is an object of the invention to provide a multiple folding stage system which may be used in a desired place inside or outside a building.

Another object of the invention is to provide a multiple folding stage system which is automatically folded or unfolded.

Still another object of the invention is to provide an electrically-operated multiple folding stage system.

A further object of the invention is to provide a multiple folding stage system whose depth when the system is unfolded is not limited by the floor-to-ceiling height of a room where the system is used.

A still further object of the invention is to provide a multiple folding stage system which provides a relatively great stage area.

A still further object of the invention is to provide a system which enables a number of linked stage systems to move sequentially from a vertical to a horizontal position, or vice-versa, as a unit in a single smooth operation.

In accordance with another feature of the invention, stays may be mounted slantingly behind the rear ends of link bars on the rear stage components of the front stage system. Also, stays may be mounted slantingly before the front ends of link bars on the front stage components of the rear stage system. Then the link mechanisms can provide a multiple folding stage system in which the front ends of both stays are linked by the link shafts.

A link member is placed in the middle in order to connect the front end of a stay projected from the rear end of a link bar, which is connected to a stage leg positioned under the rear stage of the first stage system and the front end of a link bar which is connected to a stage leg positioned under the front stage of the second stage system. Also, a slide guide and guide roller are mounted on wheel holders.

In accordance with a further feature of the invention, stays may be mounted on the rear ends of link bars on the rear stage components of the front stage system. Also, stays may be mounted on the front ends of link bars on the front stage components of the rear stage system. Then, the link mechanisms can provide a multiple folding stage system in which the front ends of both stays are linked back and forth by link member.

Especially when a turn buckle is placed as the link member in accordance with the above features of the invention space can be adjusted easily and correctly.

In accordance with yet another feature of the invention describes how the multiple folding stage system has a function enabling the stage system's lift- and runout-free performance. In other words, when the multiple folding stage system is folded or unfolded on the floor, the slide guide runs back and forth between the wheel holders for the rearmost legs under the rear stage component of the front stage system, and the wheel holders for the foremost legs under the front stage component of the rear stage system.

DETAILED DESCRIPTION OF THE PREFERRED EMBODIMENTS

The invention of an electrically-operated folding stage system includes a high-type system with comparatively long legs which are freely folded together. This system enables a multiple-version of folding stage system X1 and X2, more exactly a combination of X1 and X2 to be linked back and forth, folded up on a wall inside a building and compactly stored. This stage system shall be described in FIGS. 1 to 6 with respect to a first embodiment of the invention.

For convenience sake, the right side of the wall area in FIGS. 1 to 6 shall be considered as the front and the left side as the rear.

Figure 1:
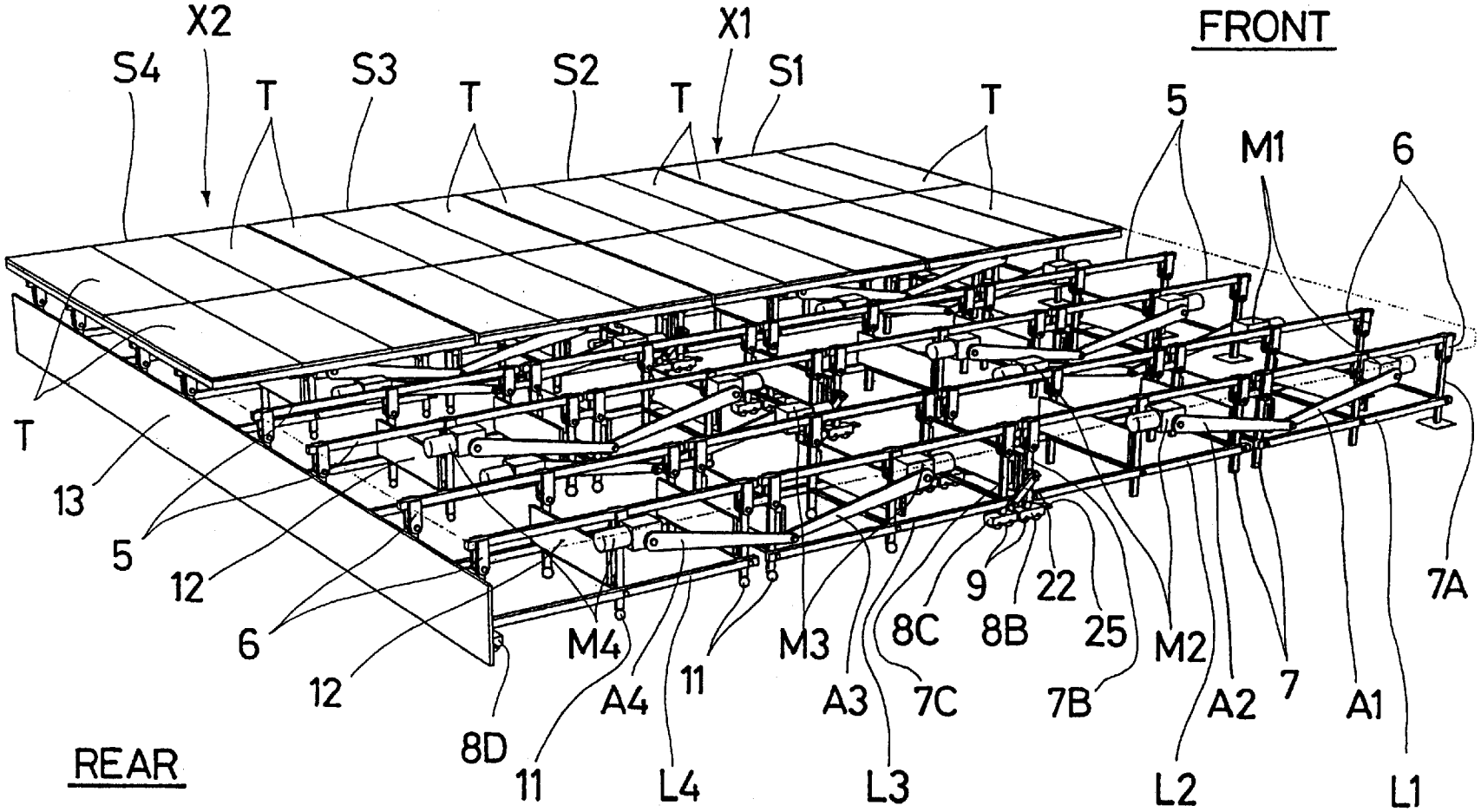
FIG. 1 is an oblique projection showing a first embodiment of the multiple folding stage system.

First of all, the basic structure of folding stage system X1 and X2 is almost the same as that of the electrically-operated folding stage system proposed in Japanese Published Examined Patent Application Nos. 7-21258 and 7-116855, Japanese Patent Nos. 2549561 and 2549562. According to the conception of its structure in the attached drawings, however, the stage system X1 which is illustrated as a front stage system (hereinafter referred to as "the first stage system), is composed of the front and rear stages S1 and S2, and the stage system X2 which is illustrated as a rear stage system (hereinafter referred to as "the second stage system). is composed of the front and rear stages S3 and S4. The link mechanisms enable articulated movements from substantially horizontal positions to substantially vertical opposed positions, thereby folding the entire opposed stage components. Stages S1 and S2 of the abovementioned first stage system X1, and stages S3 and S4 of the second stage system X2, are covered with tatami mats T as shown in FIG. 1.

Several electric motors M1 to M4 rotating in forward and reverse motions are mounted on both sides of the stage components, near the center of the front and rear stages S1 and S2 of the first stage system X1, and rear stages S3 and S4 of the second stage system. The bases of the swing arms A1 to A4 are fixed on the output shafts, and tips of the opposite swing arms A1 and A2 for the first stage system X1, and the tips of the opposite swing arms A3 and A4 for the second stage system, respectively, are connected so that these opposite arms can be freely folded.

Metal fittings 6 for stage legs 7 are fixed in the directions of depth and width of the platform 5, and are mounted together on the bottom of the first and second stage systems X1 and X2 as mentioned above. The metal fittings 6 are pivotally connected to the upper end of stage legs 7 so that legs 7 can be folded. Also, link bars L1, L2, L3 and L4 are connected to the lower end of the stage legs 7. Link shafts placed over right to left across the width of the stage legs 7 pivotally support the legs 7 of each stage and the link bars L1 to L4. Wheel holders 8B to 8D respectively are fixed to the lower ends of stage legs 7B of the rearmost row of the front stage S2 of the first stage system X1, stage legs 7C of the foremost row of the front stage S3, and stage legs 7D of the rearmost row positioned under the rear stage S4 of the second stage system X2, except for stage legs 7A of the foremost row of the front stage S1 of the first stage system X1. These wheel holders pivotally support back and forth wheels 9 rotating on the indoor floor F.

Adjustment legs 10 (or possibly adjustment pads) which can be freely adjusted for height are fixed to the lower ends of stage legs 7 of the front and rear stages S1 and S2 of the first stage system X1, except for stage legs 7A of the foremost row and stage legs 7A of the rearmost row, in order to keep the infolding first stage system X1 horizontal. Also, wheels 11 which enable the second stage system X2 to be rotated back and forth are fixed to the lower ends of stage legs 7 of the front and rear stages S3 and S4 of the second stage system X2, except for stage legs 7D of the foremost row and stage legs 7D of the rearmost row.

The lower ends of stage legs 7A of the foremost row of the front stage S1 are fixed to the floor F of a storage space so that the multiple folding stage system can be fixed, folded and stored in the storage space. In addition, the lower ends of stage legs 7A include the same wheels and holders as mentioned above so that the multiple folding stage system can be moved freely to the appropriate place.

Components 12 are reinforcing plates for stage legs 7 and are fixed between adjoining stage legs 7 on the right and left. Component 13 is a link plate fixed to the back of the wheel holders 8D of the rearmost row of the second stage system X2. Link plate 13 entirely covers the lower part of the multiple folding stage system. At the same time, the link plate may protect the rearmost stage legs 7D positioned under the rear stage S4 of the second stage system X2 from its runout, or reinforce the frames and so forth.

FIGS. 1 to 4 describe how stage legs 7 are arranged in three rows of front, middle and rear in the direction of depth of each stage S1 to S4. However, it may also be possible to fix four or five rows of stage legs 7 in the front and rear directions of depth of each stage S1 to S4 and in the right and left directions across the width so that each stage can be folded up and down.

Figure 7:
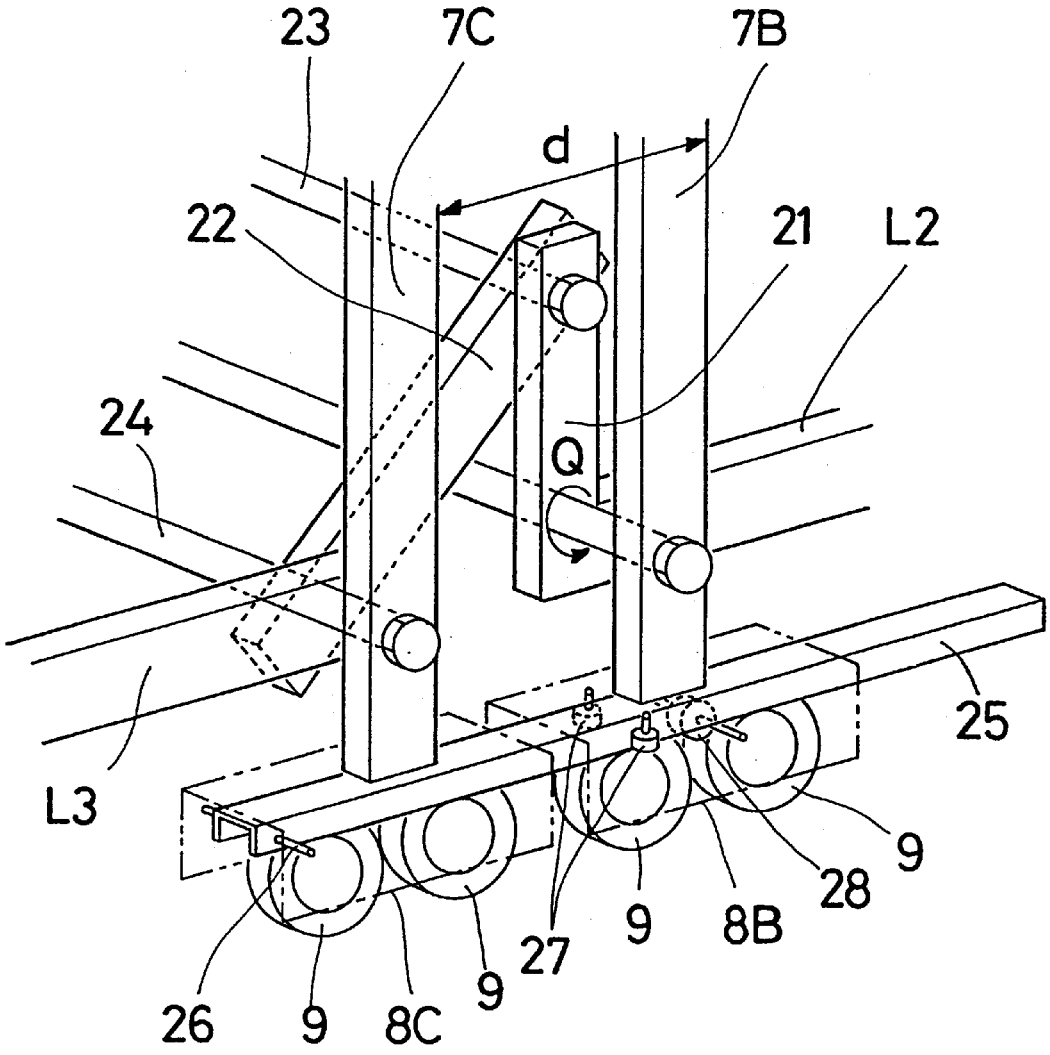
FIG. 7 is an oblique projection showing posterior connection of the first stage system and the second stage system of the multiple folding stage system of the first embodiment.

The structure of the lower part i.e. mechanisms for posterior connection of the first embodiment of the multiple folding stage system will be described herein in accordance with oblique projection FIG. 7.

Numeral 21 denotes a stay projected from the end of link bar L2. For convenience and security, one end of stay 21 may be fixed to one end of link bar L2 by welding or with bolts and nuts or the like. Numeral 22 denotes a link member such as a link, a rod, a turn buckle or the like which can be used freely to adjust the distance of the shafts, and one end of the link member 22 is placed between the right and left upper ends of stay 21 and keep it sustained together with link shaft 23. Also the other end of the link member 22 is connected to lower end of stage leg 7C and the head of link bar L3 and keep it sustained together with link shaft 24 placed across the width.

Numeral 25 denotes a belt-shaped slide guide. Both sides of slide guide 25 are bent and fixed downward to the upper part of the wheel holder 8C connected to the stage leg 7C by using pin 26. A part of the slide guide 25 is connected through the upper part of the wheel holder 8B of the stage leg 7B. Guide rollers 27 are placed on the right and left of the upper part of the said wheel holder 8B. Guide rollers 28 are placed on the upper middle area of the wheel holder 8B. These guide rollers enable the lower part of the structure to be moved back and forth. These mechanisms consequently control the positioning gap in right and left directions for wheel holders 8B and 8C which are fixed to the lower part of the posterior connection between first stage system X1 and second stage system X2, so that the multiple folding stage system may be smoothly and surely operated when it is folded, unfolded or displaced.

In FIGS. 1 to 6, link member 22 and link bars L1 to L4 are shown as fixed to the outside of stage legs 7B and 7C in order to make it easier to understand the structure. In fact, however, these features are fixed to the inside of stage legs 7B and 7C.

Figure 2:
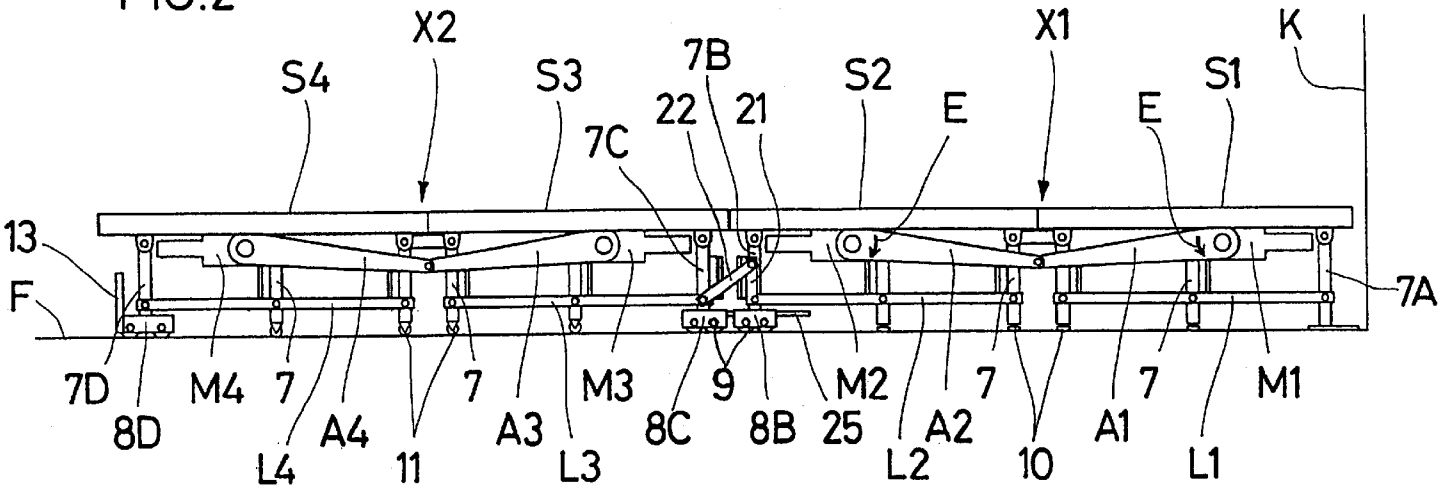
FIG. 2 is a lateral view of a first embodiment of the multiple folding stage system.
Figure 3:
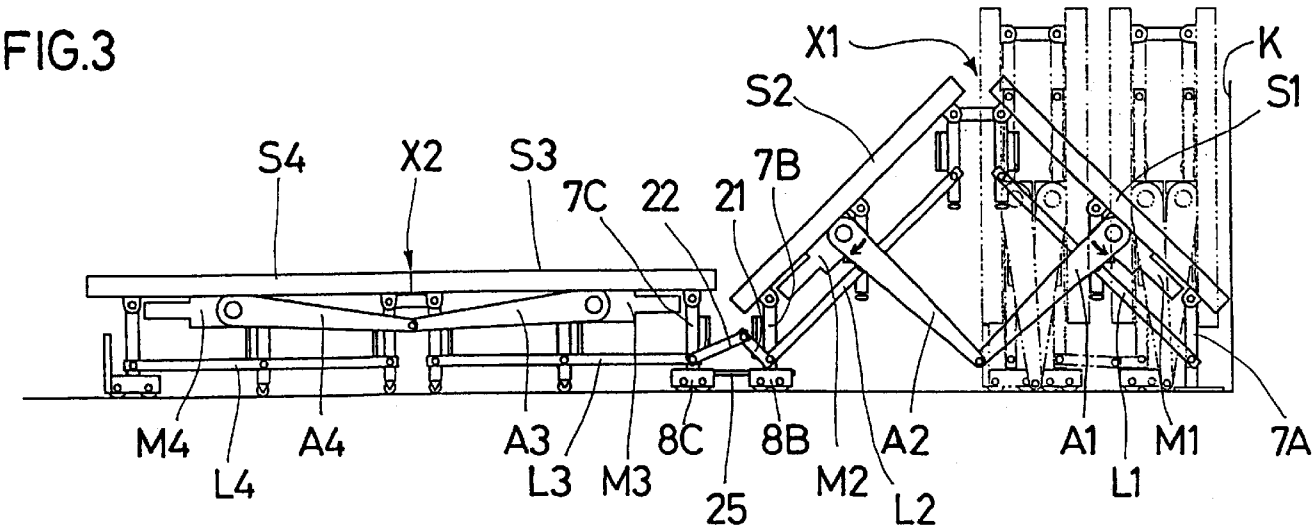
FIG. 3 is a view of the first stage system when being folded.

As shown in FIGS. 1 and 2, in order to store the multiple folding stage system, of the first embodiment, which is horizontally unfolded on the floor F inside a gymnasium or the like, to a wall area K inside the building, firstly it may be necessary to start the electric motors M1 and M2 of the first stage system X1 to rotate the output shafts in each direction of arrow E (See FIG. 2) at a very slow speed, e.g. at a reduction ratio of 1:24,000. Thus both ends of the swing arms A1 and A2 of the first stage system X1 are lowered and this generates the motor power to bring output shafts between electric motors M1 and M2, and M3 and M4 closer, in a horizontal direction. Then, these mechanisms gradually push up the rear portion of front stage S1 and the front portion of rear stage S2 so that the proximal surfaces between the front and rear stages S1 and S2 begin to rise. Following this movement, wheels 9 pivotally supported by wheel holders 8B of stage legs 7B of rear stage S2 will start rotating on floor F toward wall area K.

Figure 4:
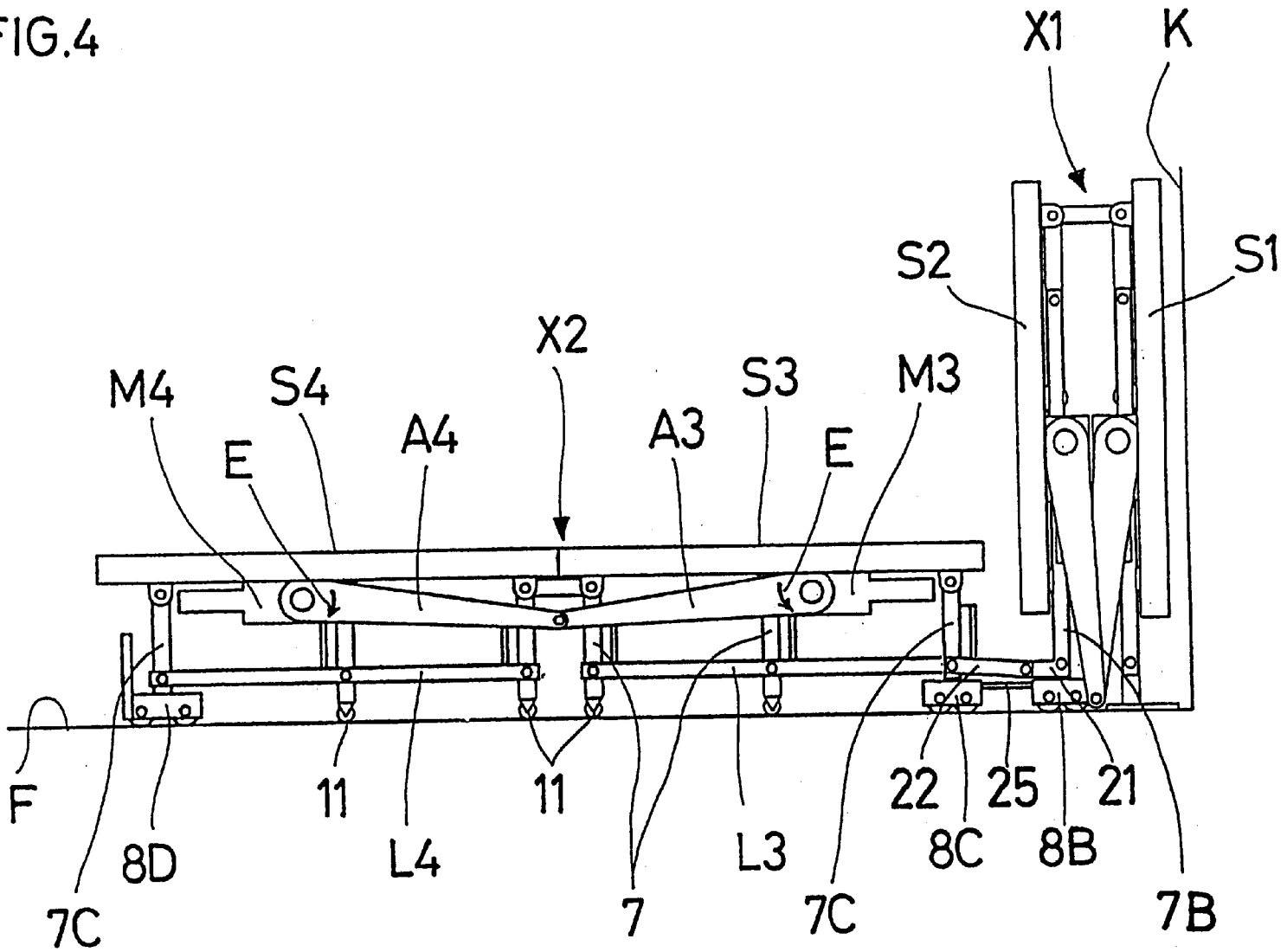
FIG. 4 is a view of the first stage system when stored against a wall area.
Figure 5:
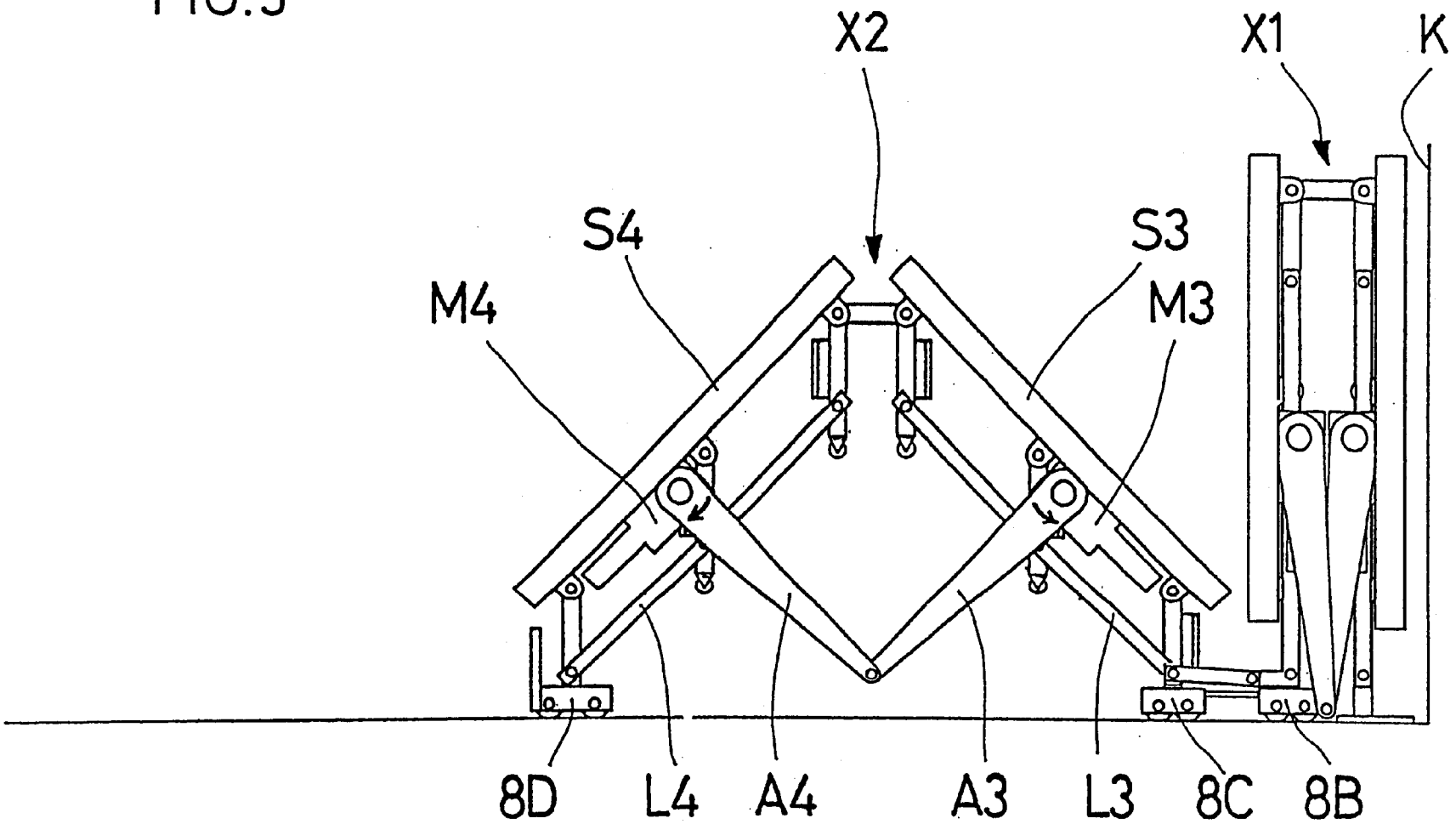
FIG. 5 is a view of the second stage system when being folded.
Figure 6:
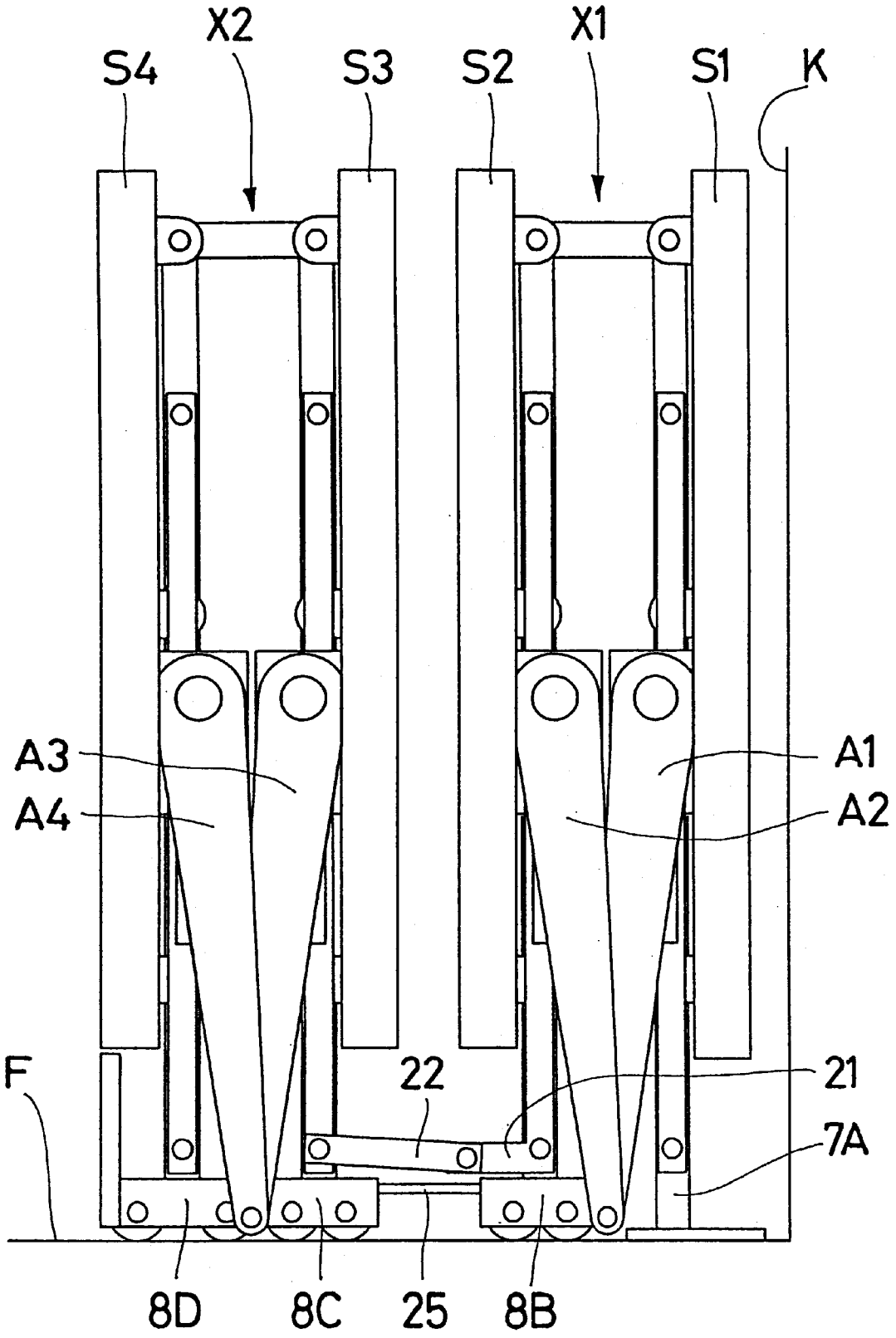
FIG. 6 is a view of the multiple folding stage system when stored against a wall area.

Also, stay 21 is vertically projected from the lower end of link bar L2 positioned under rear stage S2 of first stage system X1. The tip of stay 21 is fixed by link member 22 together with the front portion of link bar L3 positioned under front stage S3 of second stage system X2. Thus first stage system X1 is pushed up (see FIG. 3), then folded together and stored against wall area K (see FIG. 4). As shown in FIGS. 2 or 4, during the process of folding the first stage system X1, the stay 21 rotates in a direction Q (FIG. 7) so that a distance "d" between stage legs 7B and 7C increases, there by producing a sufficient clearance between the first and second stage systems. Until this point still unfolded, second stage system X2 now begins rotating foreword on floor F in accordance with the movement of first stage system X. Following this movement as shown in FIG. 5, first stage system X1 is folded up and stored against wall area K.

Then, electric motors M3 and M4 of second stage system X2 are started to rotate the output shaft in the direction of arrow E as shown in FIG. 4. The proximal surfaces of front and rear stages S1 and S2 of second stage system X2 are pushed up vertically as shown in FIG. 5, and are pulled into the first stage system which has already been folded up and stored against a wall. Finally, the multiple folding stage system consisting of first stage system X1 and second stage system X2 is folded together against wall area K.

Also, first stage system X1 of the multiple folding stage system and stage legs 7, 7A to 7D which are placed together on the lower part of front and rear stages S1 to S4 of second stage system X2, keep their upright positions as shown in FIGS. 3 to 6, move horizontally according to the folding movement of front and rear stages S1 to S4, then finally are pulled up vertically and gradually folded.

When first stage system X1 and second stage system X2 which are already folded and stored against wall area K are horizontally unfolded on floor F from wall area K, a reversal of the aforementioned processes occurs. First of all, electric motors M3 and M4 are reversed in order to rotate the output shaft in a reverse direction. This gradually generates the swing power to push open the output shaft at the supporting point of the lower end of swing arms A3 and A4. As a result, wheels 9 pivotally received by wheel holder 8D of stage leg 7D located in the foremost row of rear stage S4 are slowly rotated and pushed out. Also stage legs 7C, 7D and 7 which are folded between front and rear stages S3 and S4 keep their vertical position, move horizontally and gradually spread out. As shown in FIG. 4, the opposed front and rear stages of second stage system X2 are horizontally unfolded on floor F.

When electric motors M1 and M2 of the first stage system are reversed, the lower part of rear stage S2 is pushed away from wall area K and comes into operation, at the same time pushing unfolded second stage system X2 until the entire system is extended. Thus the multiple folding stage system composed of first stage system X1 and second stage system X2 is horizontally unfolded as shown in FIGS. 1 and 2.

Figure 9:
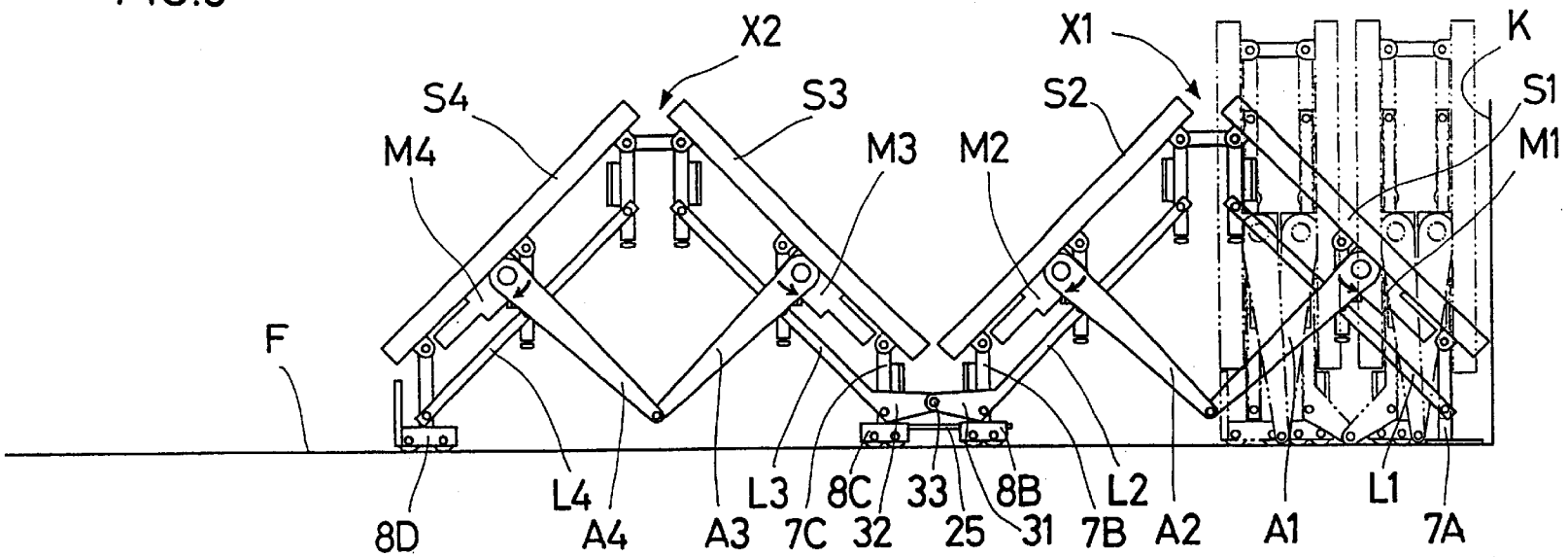
FIG. 9 is a view of the multiple folding stage system the second embodiment when being folded.
Figure 8:
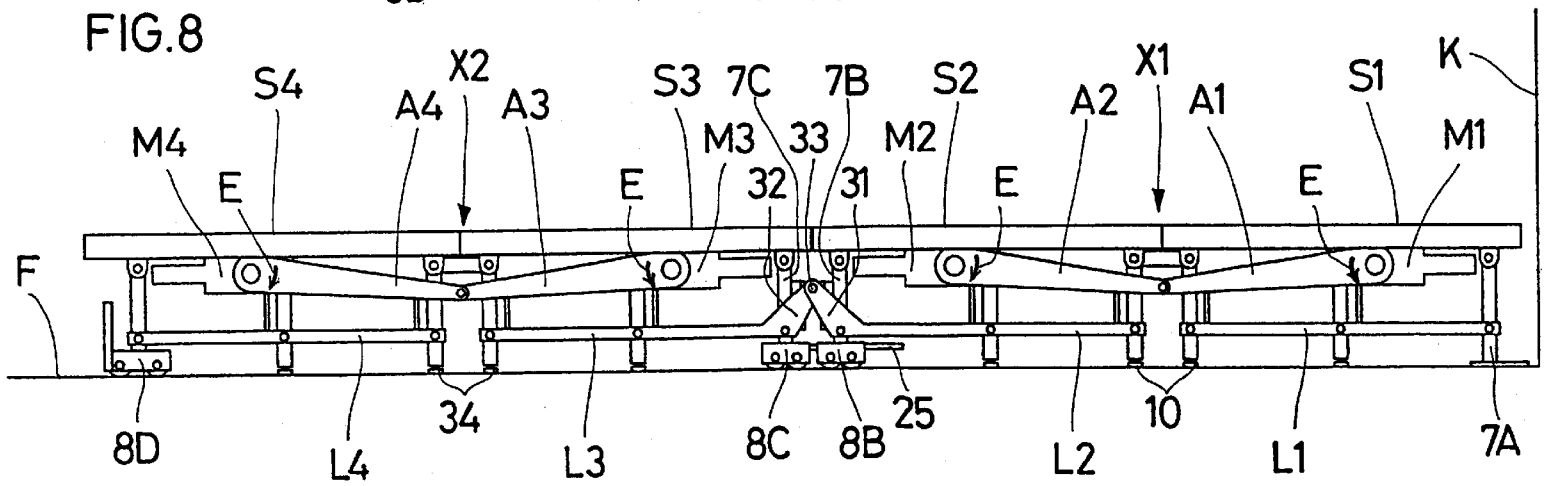
FIG. 8 is a lateral view of a second embodiment of the multiple folding stage system.
Figure 10:
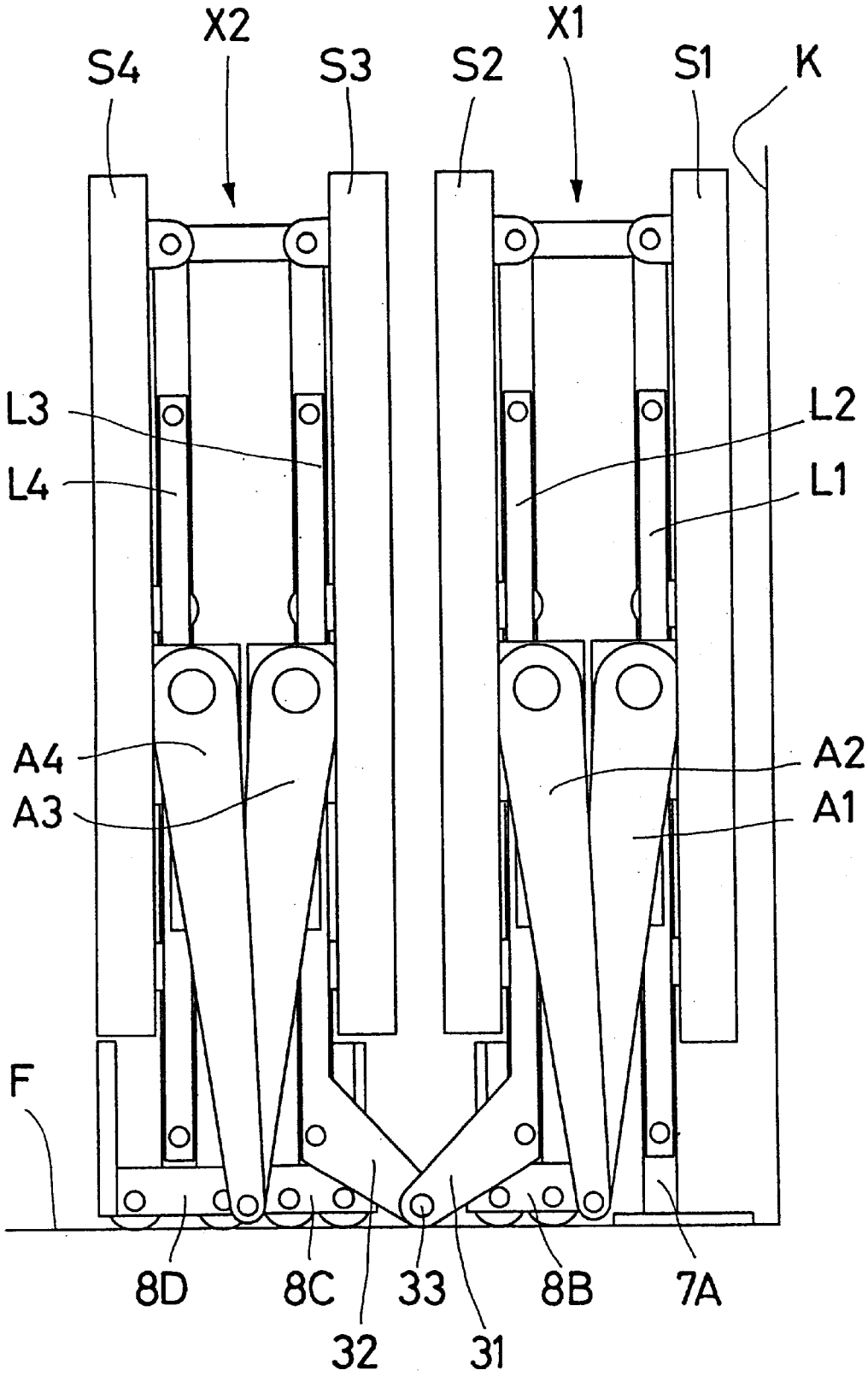
FIG. 10 is a view of the multiple folding stage system when stored against a wall area.

The second embodiment of the inventive multiple folding stage system is described herein based on FIGS. 8 to 10, in such a manner as to differentiate it from the aforementioned first embodiment.

Numeral 31 denotes a stay which is projected slantingly behind the rear end of link bar L2 and numeral 32 denotes also a stay which is projected slantingly ahead of the front end of link bar L3. Both ends of stays 31 and 32 are pivotally connected by link shaft 33. Numeral 34 denotes an adjustment leg or pad which is fixed to the bottom of stage leg 7 positioned under second stage system X2. Other features are the same as in the aforementioned Embodiment No. 1. In this case, electric motors M1 and M2 of first stage system X1 and M3 and M4 of second stage system X2 positioned under the unfolded multiple folding stage system are started almost simultaneously. Then the motor output shaft rotates in the direction of arrow E and the proximal surfaces of front and rear stages S1 and S2, and S3 and S4 are pushed up and folded as shown in FIG. 9, at the same time the proximal surfaces of first stage system X1 and second stage system X2 are gradually parted and folded downward, then stored against wall area K. As shown in FIGS. 8 and 9, when folding the first stage system X1 and the second stage system X2, the distance between stage legs 7B and 7C increases by the rotation of stays 31 and 32, there by creating a sufficient space between the first stage system X1 and the second stage system X2.

In the second embodiment, electric motors M1 to M4 fixed to first stage system X1 and second stage system X2 can be simultaneously operated to fold a number of stages. Therefore, it is not necessary to fix wheel 11 running on the floor F to stage leg 7 of second stage system X2, unlike the case in the first embodiment. Also, it is possible to store both first stage system X1 and second stage system X2 almost simultaneously, or else the time required to fold the stage systems may be reduced by as much as half compared to the first embodiment.

Figure 11:
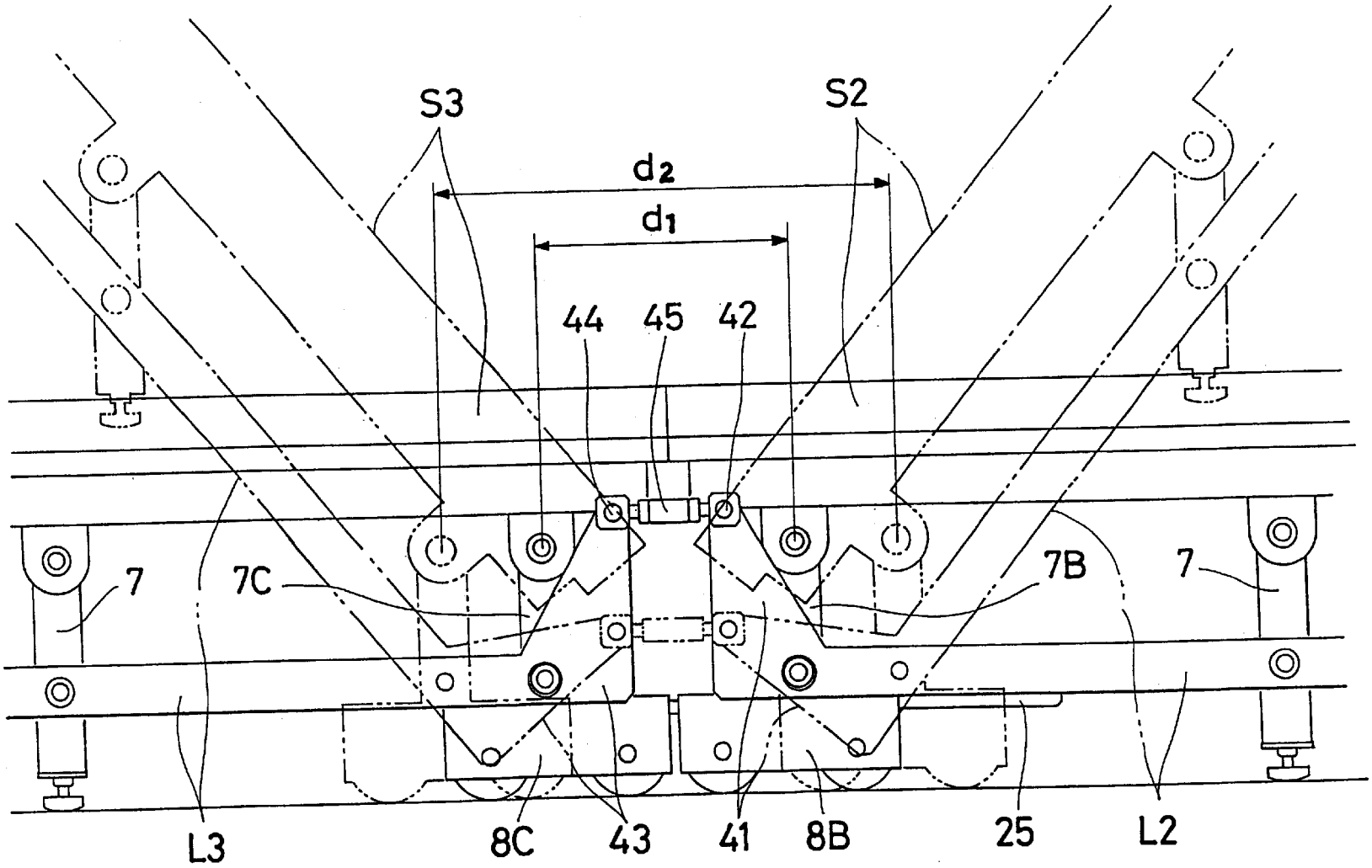
FIG. 11 is a side view of the posterior connection of the multiple folding stage system a third embodiment.
Figure 12:
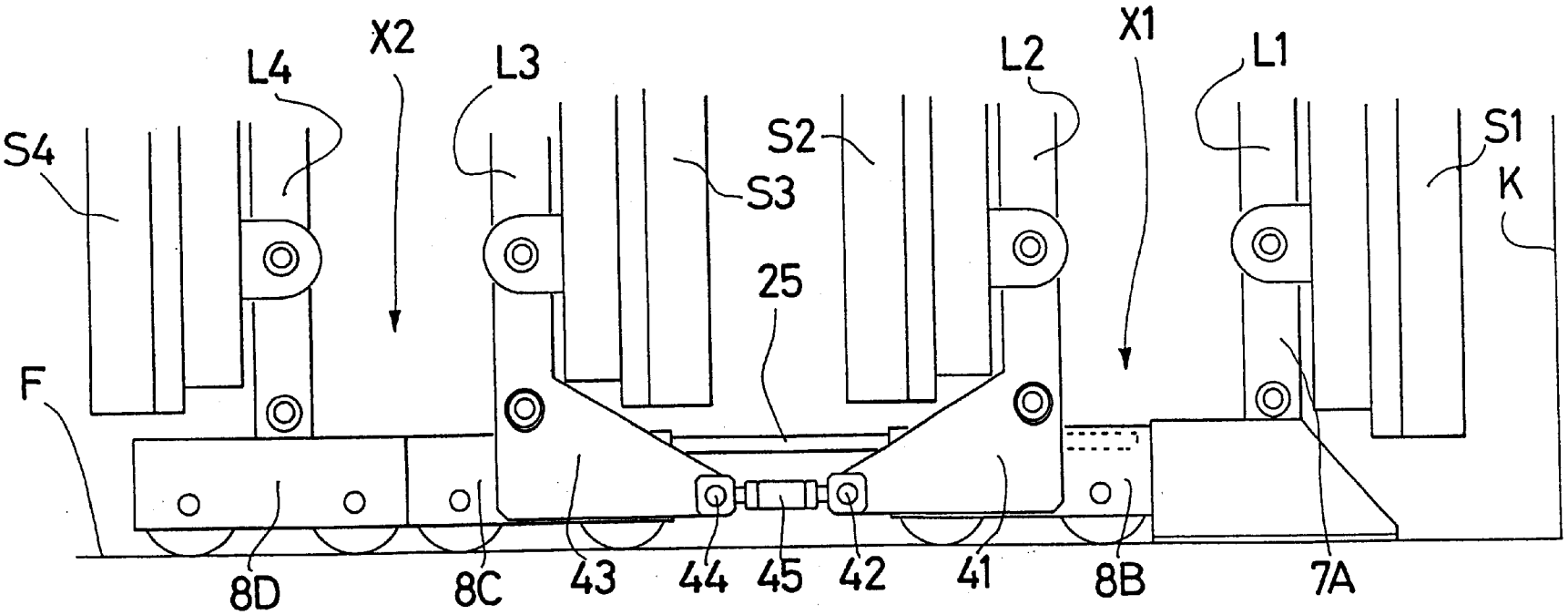
FIG. 12 is a view of the multiple folding stage system when stored against a wall area.

The third embodiment of the inventive multiple folding stage system is described herein based on FIGS. 11 and 12 in such a manner as to differentiate it from the aforementioned the first embodiment.

Numeral 41 denotes a stay projected from the rear end of link bar L2, and link shaft 42 is placed across stays widthways right and left. Numeral 43 denotes also a stay formed on the front end of link bar L3, and link shaft 44 is placed across stays widthways right and left. Numeral 45 denotes a link member such as a turn buckle which can be used freely to adjust space, and both ends of the rod penetrated the said link shafts 42 and 44 back and forth, in which the adjustment nut is tightened so that space can be freely adjusted. Other features are the same as in the aforementioned Embodiment No. 2, therefore description here is omitted as the same symbols are used. Thus, the distance between the first stage system X1 and the second stage system X2 changes such as shown eg. "d1" and "d2" of FIG. 11 to create the enough clearance therebetween.

The multiple folding stage system, of the third embodiment is operated in the same manner as the second embodiment by almost simultaneously starting the electric motors M1 and M2 fixed to first stage system X1, and M3 and M4 fixed to second stage system X2 of the unfolded multiple folding stage system. Then as the imaginary line in FIG. 12 shows, the proximal surfaces of the posterior connection between first stage system X1 and second stage system X2 are gradually parted and folded downward. Thus a number of the stages are stored against a wall area K as shown in FIG. 12.

In the third embodiment, electric motors M1 to M4 can be operated simultaneously to fold a number of stages. Therefore, it is possible to reduce the time required to store or unfold both first stage system X1 and second stage system X2 by as much as half compared to that of the first embodiment.

It will thus be appreciated that the present invention—the multiple folding stage system consisting of the aforementioned structures—enables a number of stage systems to be folded smoothly and completely, without any inconveniences such as one system component pushing up another one, or one proximal surface cutting into another one.

It may be very convenient to use this system for sports training and games e.g. judo, gymnastics, kendo or the like, because such an unfolding movement makes the proximal surfaces of the posterior connection flusher with each other, and finally provides a complete large stage floor. Especially when the stage floor of the multiple folding stage system is originally covered with tatami mats for judo or mats for gymnastics, it may not be necessary to place or take up these mats for every training event or game of judo or gymnastics, and athletes can concentrate on their practices or the like.

Also, this system can be compactly stored against a wall area inside a building. At the same time, the invention of the multiple folding stage systems No. 1, No. 2 and No. 3 respectively can be utilized for judo, gymnastics and kendo. When the stage systems for these different purposes are all stored against wall area, the building can also be used for other purposes such as a general gymnasium or the like. Therefore a gymnasium or other buildings can be used for multiple purposes, especially where there is great demand for school facilities or the like but where space is limited.

What is claimed is:

1. An electrically-operated multiple folding stage system comprising:

first and second stage systems connected in series in a front/back direction, each of said first and second stage systems having a front stage component and a rear stage component connected with one another in a manner to be freely folded or unfolded in such a way that a connection point between the front and rear stage components moves in a vertical direction;

a first link bar provided at the rear stage component of the first stage system;

a second link bar provided at the front stage component of the second stage system;

a stay integrally formed with a rear end of the first link bar in a direction inclined relative to a direction of the first link bar; and a link member pivotally connected to a front end of the second link bar at one end thereof and connected to the stay at another end thereof;

wherein the stay and the link member are pivotally connected with one another and forming an angle of connection which is substantially smaller than 180 degree when the first and second stage systems are unfolded and laying flat on a floor; and wherein the angle of connection is increased when either the first stage system or second stage system starts folding by rotation of the stay and the link member, thereby increasing a distance between the first stage system and the second stage system.

2. An electrically-operated multiple folding stage system in accordance with claim 1 wherein the angle of connection between the stay and the link member becomes about 180 degree which is a maximum angle when either the first stage system or second stage system is folded completely.

3. An electrically-operated multiple folding stage system in accordance with claim 1 wherein each of the first and second stage system is provided with a pair of swing arms which rotate by a force produced by an electric motor to establish the vertical movement of the connection point between the front and rear stage components for folding or unfolding the stage system.

4. An electrically-operated multiple folding stage system in accordance with claim 1 wherein the first link bar supports stage legs of the rear stage component of the first stage system and the second link bar supports stage legs of the front stage component of the second stage system.

5. An electrically-operated multiple folding stage system in accordance with claim 1 wherein the first link bar supports stage legs of the rear stage component of the first stage system having first wheels thereunder for promoting a front/rear movement of the first stage system and the second link bar supports stage legs of the front stage component of the second stage system having second wheels thereunder for promoting a front/rear movement of the second stage system.

6. An electrically-operated multiple folding stage system in accordance with claim 5 further comprising a slide guide extending between the first wheels of the First stage system and the second wheels of the second stage system for promoting changes in the distance between the first stage system and the second stage system by guiding a front/rear movement of the stage system.

7. An electrically-operated multiple folding stage system comprising:

first and second stage systems connected in series in a front/back direction, each of said first and second stage systems having a front stage component and a rear stage component connected with one another in a manner to be freely folded or unfolded in such a way that a connection point between the front and rear stage components moves in a vertical direction;

a first link bar provided at the rear stage component of the first stage system;

a second link bar provided at the front stage component of the second stage system;

a first stay integrally formed with a rear end of the first link bar in a direction inclined relative to a direction of the first link bar; and a second stay integrally formed with a front end of the second link bar in a direction inclined relative to a direction of the second link bar;

wherein the first stay and the second stay are pivotally connected with one another and forming an angle of connection which is substantially smaller than 180 degree when the first and second stage systems are unfolded and laying flat on a floor; and wherein the angle of connection is increased when either the first stage system or second stage system starts folding by rotation of the first stay or the second stay, thereby increasing a distance between the first stage system and the second stage system.

8. An electrically-operated multiple folding stage system in accordance with claim 7 wherein the first stage system and the second stage system perform a folding/unfolding operation separately or at the same time.

9. An electrically-operated multiple folding stage system in accordance with claim 7 wherein the angle of connection between the first stay and the second stay becomes about 180 degree which is a maximum angle when either the first stage system or second stage system is folded completely.

10. An electrically-operated multiple folding stage system in accordance with claim 7 wherein each of the first and second stage system is provided with a pair of swing arms which rotate by a force produced by an electric motor to establish the vertical movement of the connection point between the front and rear stage components for folding or unfolding the stage system.

11. An electrically-operated multiple folding stage system in accordance with claim 7 wherein the first link bar supports stage legs of the rear stage component of the first stage system and the second link bar supports stage legs of the front stage component of the second stage system.

12. An electrically-operated multiple folding stage system in accordance with claim 7 wherein the first link bar supports stage legs of the rear stage component of the first stage system having first wheels thereunder for promoting a front/rear movement of the first stage system and the second link bar supports stage legs of the front stage component of the second stage system having second wheels thereunder for promoting a front/rear movement of the second stage system.

13. An electrically-operated multiple folding stage system in accordance with claim 12 further comprising a slide guide extending between the first wheels of the first stage system and the second wheels of the second stage system for promoting changes in the distance between the first stage system and the second stage system by guiding a front/rear movement of the stage system.

14. An electrically-operated multiple folding stage system comprising:

first and second stage systems connected in series in a front/back direction, each of said first and second stage systems having a front stage component and a rear stage component connected with one another in a manner to be freely folded or unfolded in such a way that a connection point between the front and rear stage components moves in a vertical direction;

a first link bar provided at the rear stage component of the first stage system;

a second link bar provided at the front stage component of the second stage system;

a first stay integrally formed with a rear end of the first link bar in a direction inclined relative to a direction of the first link bar;

a second stay integrally formed with a front end of the second link bar in a direction inclined relative to a direction of the second link bar; and a link member for pivotally connecting the first stay and the second stay;

wherein either one or both of the first and second stays rotate when either one or both of the first and second stage systems start folding by rotation of the first stay and the second stay, thereby increasing a distance between the first stage system and the second stage system.

15. An electrically-operated multiple folding stage system in accordance with claim 14 wherein the first stage system and the second stage system perform a folding/unfolding operation separately or at the same time.

16. An electrically-operated multiple folding stage system in accordance with claim 14 wherein the link member is a turn buckle which can adjust a distance between the first stay and the second stay.

17. An electrically-operated multiple folding stage system in accordance with claim 14 wherein each off the first and second stage system is provided with a pair of swing arms which rotate by a force produced by an electric motor to establish the vertical movement of the connection point between the front and rear stage components for folding or unfolding the stage system.

18. An electrically-operated multiple folding stage system in accordance with claim 14 wherein the first link bar supports stage legs of the rear stage component of the first stage system and the second link bar supports stage legs of the front stage component of the second stage system.

19. An electrically-operated multiple folding stage system in accordance with claim 14 wherein the first link bar supports stage legs of the rear stage component of the first stage system having first wheels thereunder for promoting a front/rear movement of the first stage system and the second link bar supports stage legs of the front stage component of the second stage system having second wheels thereunder for promoting a front/rear movement of the second stage system.

20. An electrically-operated multiple folding stage system in accordance with claim 19 further comprising a slide guide extending between the first wheels of the first stage system and the second wheels of the second stage system for promoting changes in the distance between the first stage system and the second stage system by guiding a front/rear movement of the stage system.

* * * * *